US009260916B1

(12) United States Patent
Brotherton

(10) Patent No.: US 9,260,916 B1
(45) Date of Patent: Feb. 16, 2016

(54) COMBINATION FIRE-TRUCK LADDER AND SLIDE

(71) Applicant: Tabatha T Brotherton, Fort Worth, TX (US)

(72) Inventor: Tabatha T Brotherton, Fort Worth, TX (US)

( * ) Notice: Subject to any disclaimer, the term of this patent is extended or adjusted under 35 U.S.C. 154(b) by 0 days.

(21) Appl. No.: 14/220,477

(22) Filed: Mar. 20, 2014

Related U.S. Application Data

(60) Provisional application No. 61/960,021, filed on Sep. 9, 2013.

(51) Int. Cl.
*E06C 5/02* (2006.01)

(52) U.S. Cl.
CPC ..... *E06C 5/02* (2013.01)

(58) Field of Classification Search
CPC ..... E06C 1/383; E06C 1/3835; E06C 1/39; E06C 1/393; E06C 5/00; E06C 5/02; E06C 5/04; E06C 5/06; E06C 7/00; E06C 1/38; E06C 1/387; E06C 7/082; A62B 1/00; A62B 1/02; A62B 1/20; A62B 5/00; B66F 11/04; E01D 15/24
See application file for complete search history.

(56) References Cited

U.S. PATENT DOCUMENTS 1,215,827 A * 2/1917 Lord ..... 182/1
2,864,542 A * 12/1958 Marryatt ..... 182/21
3,598,215 A * 8/1971 Summer et al. ..... 193/25 B
4,366,591 A * 1/1983 Zimmerman ..... 14/71.3
4,506,825 A * 3/1985 Grant ..... 236/9 A
4,602,697 A * 7/1986 Aanensen ..... 182/48
4,971,168 A * 11/1990 Stanescu ..... 182/1
5,273,133 A * 12/1993 Thocher et al. ..... 182/202
5,421,757 A * 6/1995 Basiliere ..... 441/39
5,454,196 A * 10/1995 Gaines et al. ..... 52/183
5,711,495 A * 1/1998 Danielson ..... 244/137.2
5,794,292 A * 8/1998 Ricci, Jr. ..... 14/69.5
5,967,260 A * 10/1999 Spak ..... 182/165
6,234,273 B1 * 5/2001 Moore ..... 182/204
6,347,687 B1 * 2/2002 Alim ..... 182/161
6,408,984 B1 * 6/2002 Cavagnaro ..... 182/205
6,550,579 B2 * 4/2003 Gibson et al. ..... 182/161
6,755,146 B1 * 6/2004 Garelick et al. ..... 114/362
6,845,845 B2 * 1/2005 Schmid, Jr. ..... 182/84
6,923,140 B1 * 8/2005 Cook ..... 114/362
7,353,636 B1 * 4/2008 Anderson et al. ..... 49/82.1
7,621,236 B2 * 11/2009 Steffey et al. ..... 119/847
D624,200 S * 9/2010 Kieffer et al. ..... D25/65
7,806,233 B2 * 10/2010 Parker ..... 182/207
8,006,803 B2 * 8/2011 Guering ..... 182/100
8,127,890 B2 * 3/2012 Meyers et al. ..... 182/21
8,672,279 B2 * 3/2014 Schirmacher et al. ..... 248/210
8,857,106 B2 * 10/2014 Colson ..... 49/403
2002/0148165 A1 * 10/2002 LaMay ..... 49/403
2004/0074696 A1 * 4/2004 Horvath et al. ..... 182/48
2005/0060940 A1 * 3/2005 Alexander et al. ..... 49/403
2005/0076569 A1 * 4/2005 Griffiths et al. ..... 49/82.1

(Continued)

*Primary Examiner* — Katherine Mitchell
*Assistant Examiner* — Shiref Mekhaeil
(74) *Attorney, Agent, or Firm* — Kenneth L Tolar

(57) ABSTRACT

A ladder for a fire truck includes a plurality of telescoping ladder-frame sections, each formed of a pair of spaced side rails having a C-shaped cross section for slidably receiving a corresponding side rail on an adjacent section. Positioned between each of the side rails are a plurality of motorized platforms that are deployable to provide a series of horizontal stairs for ascending the ladder. The platforms may also be inverted until they are parallel with the side rails to form a slide on which a fire victim may easily descend to safety.

18 Claims, 2 Drawing Sheets

(56) References Cited

U.S. PATENT DOCUMENTS

2005/0257429 A1* 11/2005 Yorgason ..... 49/82.1
2006/0006023 A1* 1/2006 Lim ..... 182/127
2007/0101516 A1* 5/2007 Carrigan ..... 14/69.5
2007/0246435 A1* 10/2007 Crookston ..... 212/264
2009/0149123 A1* 6/2009 Blagg ..... 454/258
2012/0042458 A1* 2/2012 Bennett et al. ..... 14/71.3
2013/0037350 A1* 2/2013 Geiselman et al. ..... 182/108
2013/0213737 A1* 8/2013 Bambrick et al. ..... 182/18
2013/0292205 A1* 11/2013 Frick et al. ..... 182/156

* cited by examiner

COMBINATION FIRE-TRUCK LADDER AND SLIDE

CROSS REFERENCE TO RELATED APPLICATIONS

This application is entitled to the benefit of provisional patent application No. 61/960,021 filed on Sep. 9, 2013, the specification of which is incorporated herein by reference.

BACKGROUND OF THE INVENTION

The present invention relates to a fire-truck ladder that can be easily converted into a slide for a trapped fire victim.

DESCRIPTION OF THE PRIOR ART

A conventional fire truck includes a turntable ladder that is extended to allow a fireman to reach elevated areas of a burning building. If a rescue is necessary, only one person can descend the ladder at a time due to the weight capacity of the ladder. Rescuing people in such fashion can be extremely difficult, time consuming and sometimes futile if numerous people are trapped, or if any are elderly or disabled.

Accordingly, there is currently a need for a fire-truck ladder that allows a fireman to more quickly rescue a person trapped in a burning building. The present invention addresses this need by providing a ladder having a plurality of platforms that can be deployed to form steps for the fireman, or inverted to form a slide for the trapped victim.

SUMMARY OF THE INVENTION

The present invention relates to a fire-truck ladder comprising a plurality of telescoping frame sections, each formed of a pair of spaced side rails having a C-shaped cross section for slidably receiving a corresponding side rail on an adjacent section. Positioned between each of the side rails are a plurality of motorized platforms that are deployable to provide a series of horizontal stairs for ascending the ladder. The platforms may also be inverted to form a slide on which a fire victim may easily descend to safety.

It is therefore an object of the present invention to provide a fire-truck ladder that is easily converted to a slide for trapped victims.

It is another object of the present invention to provide a fire-truck ladder having horizontal steps that are safer to ascend than conventional ladder rungs.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
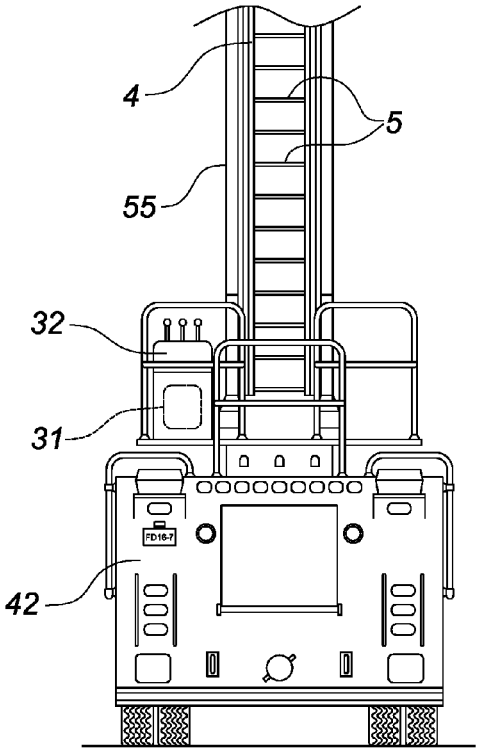
FIG. 1 is a rear view of an exemplary fire truck having the ladder according to the present invention mounted thereon.
Figure 2:
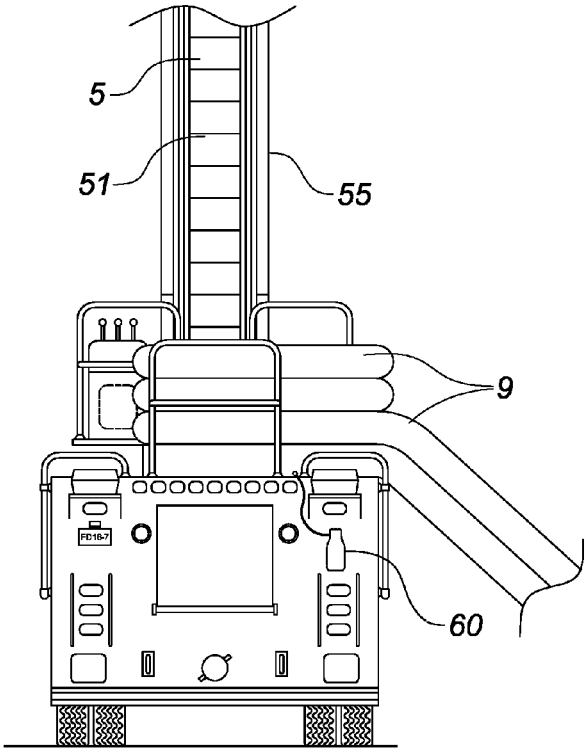
FIG. 2 depicts the truck of FIG. 1 with the inflatable chute deployed.
Figure 3:
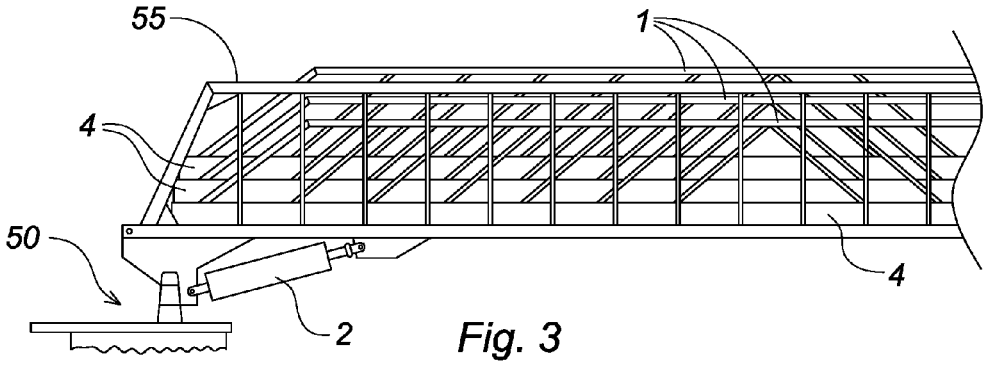
FIG. 3 is an isolated, side view of the ladder.
Figure 4:
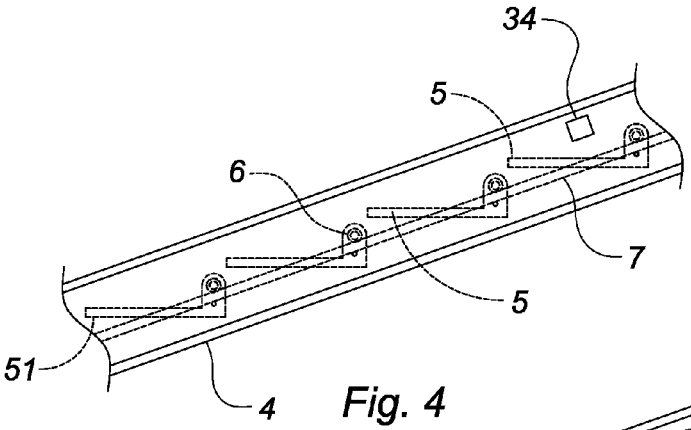
FIG. 4 is a sectional view of an exemplary side rail with the platforms in a deployed orientation.
Figure 5:
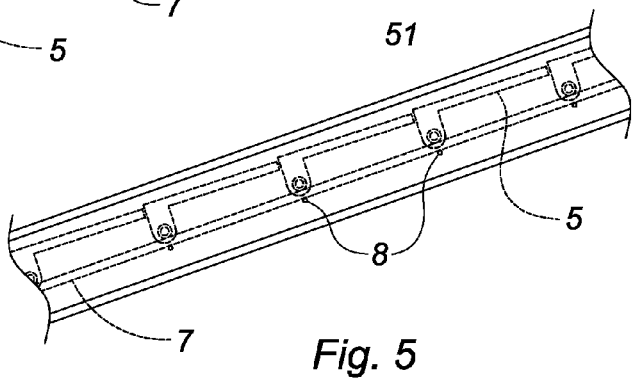
FIG. 5 is a sectional view of a side rail with the platforms in an inverted, collapsed orientation.
Figure 6:
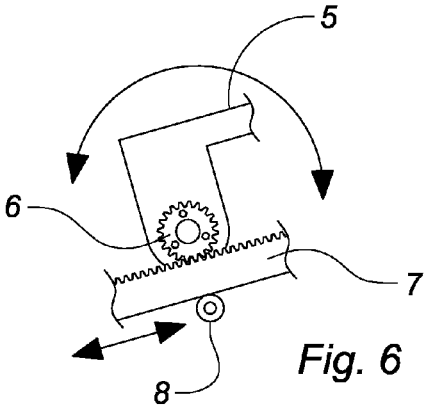
FIG. 6 is a detailed view of the linear gear rack and an exemplary spur gear.

The present invention relates to a fire-truck ladder comprising a plurality of frame sections 1, each nested within an adjacent frame section to allow telescopic extension and retraction. A lowermost section is attached to the hydraulic lifting cylinders 2 and associated turntable assembly 50 found on conventional fire trucks 42 that rotate, raise and lower the ladder. Similar cylinders automatically extend and retract the frame sections in a conventional fashion.

Each section 1 is formed of a pair of spaced side rails 4, each having a C-shaped cross section for slidably receiving a corresponding side rail on an adjacent section. Positioned between each of the side rails are a plurality of platforms 5 having an upper surface on which a fireman steps when ascending the ladder. The lower surface 51 of each platform is covered with a layer of urethane fabric or similar material to provide a smooth surface on which a victim can slide. Each platform also includes two opposing side edges, each having a spur gear 6 mounted thereon that engages a linear gear rack 7 positioned within each of the side rails. A series of bearings 8 engage an opposing surface of the gear rack to maintain firm contact between the gear rack and spur gears.

A motor 31 at the lower end of each section moves the gear rack upwardly or downwardly to pivot the platforms between deployed and inverted positions. In the deployed position, the steps extend outwardly from the side rails to provide a series of horizontal stairs on which a fireman steps when climbing the ladder. In the inverted position, the platforms are parallel to the side rails, with the lower surfaces facing upwardly, to form a planar slide on which a fire victim may easily descend to safety. The nested ladder sections are positioned between a pair of safety banisters 55 that the victim grasps to prevent an unsafe or uncomfortable descent.

A controller 32 in communication with the motors either deploys or inverts the platforms, and rotates, extends and retracts the ladder sections. On at least one of the ladder sections is an inclinometer 34 that communicates with the controller and motors to maintain the ladder at or below a predetermined, maximum angle. The controller also interrogates the inclinometer to maintain the platforms in a horizontal position regardless of the ladder angle.

The ladder according to the present invention also preferably includes an inflatable chute 9 at a lower end to assist the victim with descending from the truck to ground level. The slide is automatically inflated with a cannister 60 of nitrogen, compressed air or a similar gas. Aspirators on a safety valve draw in ambient air to increase inflation speed.

Accordingly, to rescue a stranded fire victim, a truck operator lifts the ladder and extends the sections to a position that allows a fireman to access the victim. The operator deploys the platforms to a horizontal position and the fireman ascends the ladder to assist the victim. The fireman then stands on a bucket or similar support surface at an upper end of the ladder while the operator inverts the platforms to form a slide on which the victim can descend into the fire truck. Simultaneously, the operator inflates the slide to allow the victim to safely exit the vehicle.

The above-described device is not limited to the exact details of construction and enumeration of parts provided herein. Furthermore, the size, shape and materials of construction of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A combination ladder and slide for a fire truck comprising:

a pair of opposing side rails, each having an upper end and a lower end;

a plurality of platforms positioned between said side rails, each of said platforms having two opposing side edges, an upper surface and a lower surface;

means for pivoting said platforms between a first, deployed position and a second, inverted position, in said first, deployed position, said platforms are at an angle relative to said side rails to form steps, and in said second, inverted position, said platforms are parallel to said side rails due to each platform of the plurality of platforms rotating more than ninety degrees such that each of the lower surfaces faces upwardly to form a planar slide.

2. The ladder according to claim 1 wherein said means for pivoting said platforms comprises:

a linear gear rack within at least one of said side rails;

a gear on one of the side edges of each of said platforms and engaging said linear gear rack;

means for moving said gear rack in either of two directions to rotate said gears and pivot said platforms.

3. The ladder according to claim 2 wherein said means for moving said gear rack in either of two directions to rotate said gears and pivot said platforms comprises a motor that linearly translates said gear rack.

4. The combination according to claim 3 further comprising an inclinometer on one of said side rails and in communication with said motor to maintain said side rails below a predetermined angle, and to maintain said platforms in a horizontal position regardless of an angle of said side rails.

5. The combination according to claim 1 further comprising an inflatable chute near the lower end of said side rails for assisting a victim with descending from the truck to ground level.

6. The combination according to claim 5 wherein said chute is automatically inflated with a cannister of compressed gas.

7. The combination according to claim 6 further comprising a safety valve having at least one aspirator thereon for inputting ambient air to said chute to increase inflation speed.

8. A combination ladder and slide for a fire truck comprising:

a plurality of telescoping ladder-frame sections, each of said frame sections formed of a pair of spaced side rails, means for raising, lowering, extending and retracting said ladder-frame sections;

a plurality of pivotal platforms positioned between each of said side rails, each of said platforms having an upper surface, a lower surface and two opposing side edges;

means for moving said platforms between a deployed position wherein the platforms extend outwardly from said side rails, and a collapsed position wherein said platforms are parallel to said side rails due to each platform of the plurality of platforms rotating more than ninety degrees such that each of the lower surfaces faces upwardly to form a planar slide.

9. The combination according to claim 8 wherein said means for moving said platforms between a deployed position wherein the platforms extend outwardly from said side rails, and a collapsed position comprises:

a gear mounted on each of the two opposing side edges of said platforms;

a linear gear rack positioned within each of said side rails, said gear rack having a first side engaging said gear;

means for moving said gear rack in either of two directions.

10. The combination according to claim 9 wherein either of the upper surface and the lower surface of each of said platforms is covered with a layer of urethane fabric to provide a smooth surface on which a victim can slide.

11. The combination according to claim 9 further comprising a series of bearings engaging a second side of said gear rack to maintain firm contact between the gear rack and said gear.

12. The combination according to claim 9 wherein said means for moving said gear rack in either of two directions comprises a motor.

13. The combination according to claim 12 further comprising an inclinometer on one of said ladder-frame sections and in communication with said motor to maintain said ladder-frame sections below a predetermined angle, and to maintain said platforms in a horizontal position regardless of an angle of said ladder-frame sections.

14. The combination according to claim 13 further comprising an inflatable chute near a lower end of a lowermost ladder-frame section for assisting a victim with descending from the truck to ground level.

15. The combination according to claim 14 wherein said chute is automatically inflated with a cannister of compressed gas.

16. The combination according to claim 12 further comprising a controller in communication with said motor that deploys and inverts said platforms, and rotates, extends and retracts said ladder-frame sections.

17. The combination according to claim 16 further comprising an inclinometer in communication with said controller and said motor to maintain the ladder at or below a predetermined, maximum angle and to maintain said platforms in a horizontal position regardless of an angle of said ladder.

18. In combination with a fire truck having at least one hydraulic lifting cylinder and a turntable assembly, a combination ladder and slide comprising:

a pair of opposing side rails, each of said opposing side rails having an upper end and a lower end, the lower end attached to the hydraulic lifting cylinder and the turntable assembly that lift and rotate said side rails;

a plurality of platforms positioned between said side rails, each of said platforms having two opposing side edges, an upper surface and a lower surface;

means for pivoting said platforms between a first, deployed position and a second, inverted position, in said first, deployed position, said platforms are at an angle relative to said side rails to form steps, and in said second, inverted position, said platforms are parallel to said side due to each platform of the plurality of platforms rotating more than ninety degrees such that each of the lower surfaces faces upwardly to form a planar slide.

* * * * *